US005940659A

United States Patent [19]

Rieck

[11] Patent Number: 5,940,659

[45] Date of Patent: Aug. 17, 1999

[54] DUAL MODE PIVOTING TRAY PROVIDING LOWER TRAY ACCESS AND DOCUMENT HANDLER JAM ACCESS

[75] Inventor: Kenneth J. Rieck, Victor, N.Y.

[73] Assignee: Xerox Corporation, Stamford, Conn.

[21] Appl. No.: 09/212,996

[22] Filed: Dec. 16, 1998

[51] Int. Cl.[6] ..... G03G 15/20

[52] U.S. Cl. ..... 399/124; 399/21; 399/369

[58] Field of Search ..... 399/17, 21, 124, 399/361, 365, 367, 369

[56] References Cited

U.S. PATENT DOCUMENTS

| | | | |
|---|---|---|---|
| 5,095,334 | 3/1992 | Nukaya | 399/124 X |
| 5,331,374 | 7/1994 | Abe et al. | 399/124 |
| 5,339,139 | 8/1994 | Fullerton et al. | 399/367 X |
| 5,363,184 | 11/1994 | Matsuo et al. | 399/367 |
| 5,515,150 | 5/1996 | Yoshie et al. | 399/367 |
| 5,534,989 | 7/1996 | Rubscha et al. . | |
| 5,731,885 | 3/1998 | Nagahara | 399/21 X |
| 5,832,356 | 11/1998 | Kurando et al. | 399/367 X |

*Primary Examiner*—Sandra Brase

[57] ABSTRACT

An improved sheet jam removal system for a sheet feeding system with an enclosed internal sheet feeding path unit and connecting first and second sheet stacking trays. The first tray is overlying the second and is pivotally cantilever mounted about a first pivot axis so that when a sheet feeding jam occurs the first tray readily manually pivots upwardly about the first pivot axis to expose sheets in the second tray, and also a camming surface on the tray, which may be provided by edge guides adjacent the first pivot axis, engages and automatically unlatches, with high leverage, a top cover of the enclosed sheet feeding path unit, which top cover pivots open about a second pivot axis spaced from the first. The top cover may be spring loaded to automatically pop further open for full exposure and removal of sheets inside the unit upon said automatic unlatching.

5 Claims, 4 Drawing Sheets

DUAL MODE PIVOTING TRAY PROVIDING LOWER TRAY ACCESS AND DOCUMENT HANDLER JAM ACCESS

Disclosed in the embodiment herein is an improved, more intuitive, user-friendly and lower force sheet jam clearance system for providing improved access to both the sheets underlying a tray and the document sheet path within the document feeder or other sheet feeding apparatus.

One of the difficulties in feeding flimsy sheets of various sizes and conditions, typical of original documents in particular, but also copy sheets to be printed, is that misfeeds or other sheet feeding jams can occur which require the user or operator to clear sheets from the system and restart the document scanning and/or copying process. It is known in xerographic printers, copiers and other reproduction devices to provide an operator graphic user interface or "GUI", such as a display of instructions and/or flashing lights to indicate to the operator that a jam has occurred. It is well-known to provide GUI displayed instructions of various kinds to instruct the operator, verbally or with illustrations, for what is called "jam clearance" and "job recovery". In particular, which components of the machine, including access covers, must be opened, lifted, pulled out, or the like to clear jammed sheets, and then how to reload and restart the system for job recovery. It is also known that the lifting of one cover can be tied by a wire connection or the like to also lift therewith an internal baffle within the paper path for jam clearance.

The embodiment disclosed herein is a document imaging system for sequentially feeding the document sheets of a set of documents to be imaged, preferably digitally, for copying, local printing, facsimile transmission, or electronic document storage for subsequent or remote printing. Further details of the document handler example shown herein are disclosed in Xerox Corporation U.S. Pat. No. 5,534,989, issued Jul. 9, 1996 to Robert F. Rubscha, et al., and other references cited therein. However, the principles disclosed herein need not be limited to this specific embodiment, and could be applied to other document or copy sheet feeding systems.

The disclosed embodiment provides an improved, more user-friendly, document jam clearance system, in which, in the event of a document jam signal, it is both easy and intuitive to access and check for clearing sheets under an overlying entrance tray, since any sheets in that area may need to be removed before restarting the document feeding and imaging operation, and also to check for and potentially remove sheets inside the document feeding unit for these trays. As disclosed herein, the lifting of the overlying tray automatically provides a highly leveraged unlatching and partial opening of the document feeder access cover to automatically expose the most likely document jam sites inside the document handler unit, without requiring any separate operator instructions or any separate operator steps. The operator is immediately visually clued by the automatic lifting of the external cover upon the lifting movement of the overlying document tray, as will be further explained herein.

A specific feature of the specific embodiment disclosed herein is to provide in a sheet feeding system with an enclosed internal sheet feeding path unit and at least two connecting first and second sheet stacking trays, wherein said first sheet stacking tray is overlying said second sheet stacking tray, and wherein sheets are sequentially fed from at least one of said first or second superposed sheet stacking trays into said enclosed internal sheet feeding path unit; and wherein a sheet jam signal generating system is provided in the event of a sheet feeding jam; the improvement wherein: said first sheet stacking tray is pivotally cantilever mounted adjacent one end thereof to said enclosed internal sheet feeding path unit at a first pivot axis and extends cantilevered from said enclosed internal sheet feeding path unit, said first sheet stacking tray being readily manually pivotal upwardly about said first pivot axis to expose said second sheet stacking tray in the event of said sheet feeding jam signal, said first sheet stacking tray having a camming surface adjacent to said first pivot axis and at least partially inside of said enclosed internal sheet feeding path unit; said enclosed internal sheet feeding path unit having a top cover pivotally mounted to said enclosed internal sheet feeding path unit about a second pivot axis substantially spaced from said first pivot axis of said first sheet stacking tray, a releasable latching system latching said top cover down over said enclosed internal sheet feeding path unit, said top cover having a latch releasing engagement surface positioned to be engaged by said camming surface of said first sheet stacking tray to automatically release said releasable latching system and at least partially open said top cover when said first sheet stacking tray is manually pivoted upwardly about said first pivot axis to expose said second sheet stacking tray.

Further specific features disclosed herein, individually or in combination, include those wherein said first and second sheet stacking trays are respectively document input and document output trays, and wherein said enclosed internal sheet feeding path unit comprises a document imaging system; and/or wherein: said enclosed internal sheet feeding path unit has first and second opposite sides, said first and second sheet stacking trays are mounted to said first side of said enclosed internal sheet feeding path unit, said first pivot axis is adjacent to said first side of said enclosed internal sheet feeding path unit, and said second pivot axis is adjacent to said second side of said enclosed internal sheet feeding path unit; and/or wherein said top cover is spring loaded to pop open and expose said enclosed internal sheet feeding path when said camming surface of said manually pivoted first sheet stacking tray engages said latch releasing engagement surface of said top cover and releases said releasable latching system; and/or wherein said camming surface of said first sheet stacking tray is an arcuate top surface of a sheet side guide on said tray, which sheet side guide is upstanding from said tray and extends into said enclosed internal sheet feeding path unit to engage said top cover when said tray is manually pivoted upwardly.

In the claims herein the terms "document" or "sheet" interchangeably refers to a flimsy physical sheet of paper, plastic, or other suitable physical substrate for images, or copies of images.

As to specific components of the subject apparatus, or alternatives therefor, it will be appreciated that, as is normally the case, some such components are known per se in other apparatus or applications which may be additionally or alternatively used herein, including those from art cited herein. All references cited in this specification, and their references, are incorporated by reference herein where appropriate for appropriate teachings of additional or alternative details, features, and/or technical background. What is well known to those skilled in the art need not be described here.

Various of the above-mentioned and further features and advantages will be apparent from the specific apparatus and its operation described in the example below, and the claims. Thus, the present invention will be better understood from this description of a specific embodiment, including the drawing figures (approximately to scale) wherein:

Figure 2:
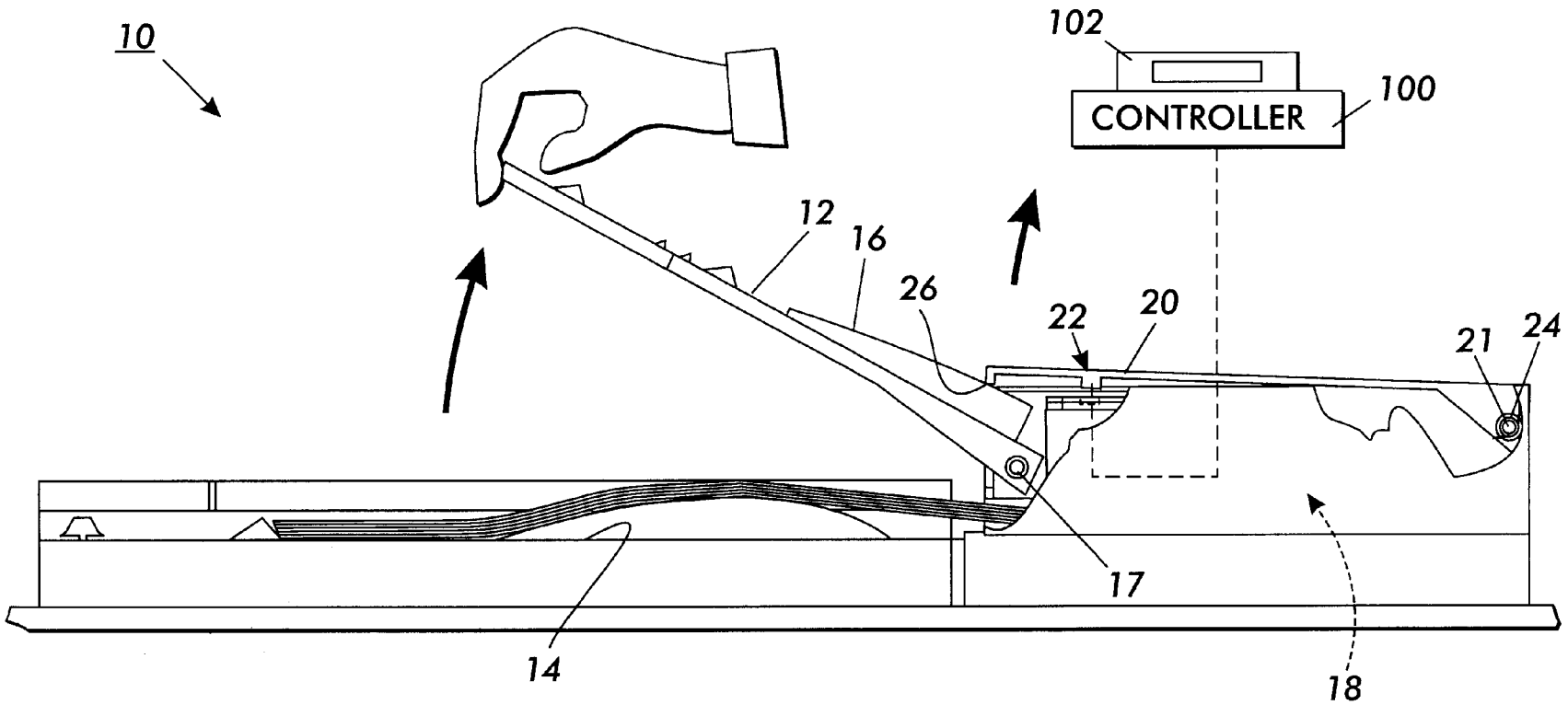
FIG. 2 is a partial front view of the embodiment of FIG. 1 showing the initial jam clearance operation and component movement.
Figure 3:
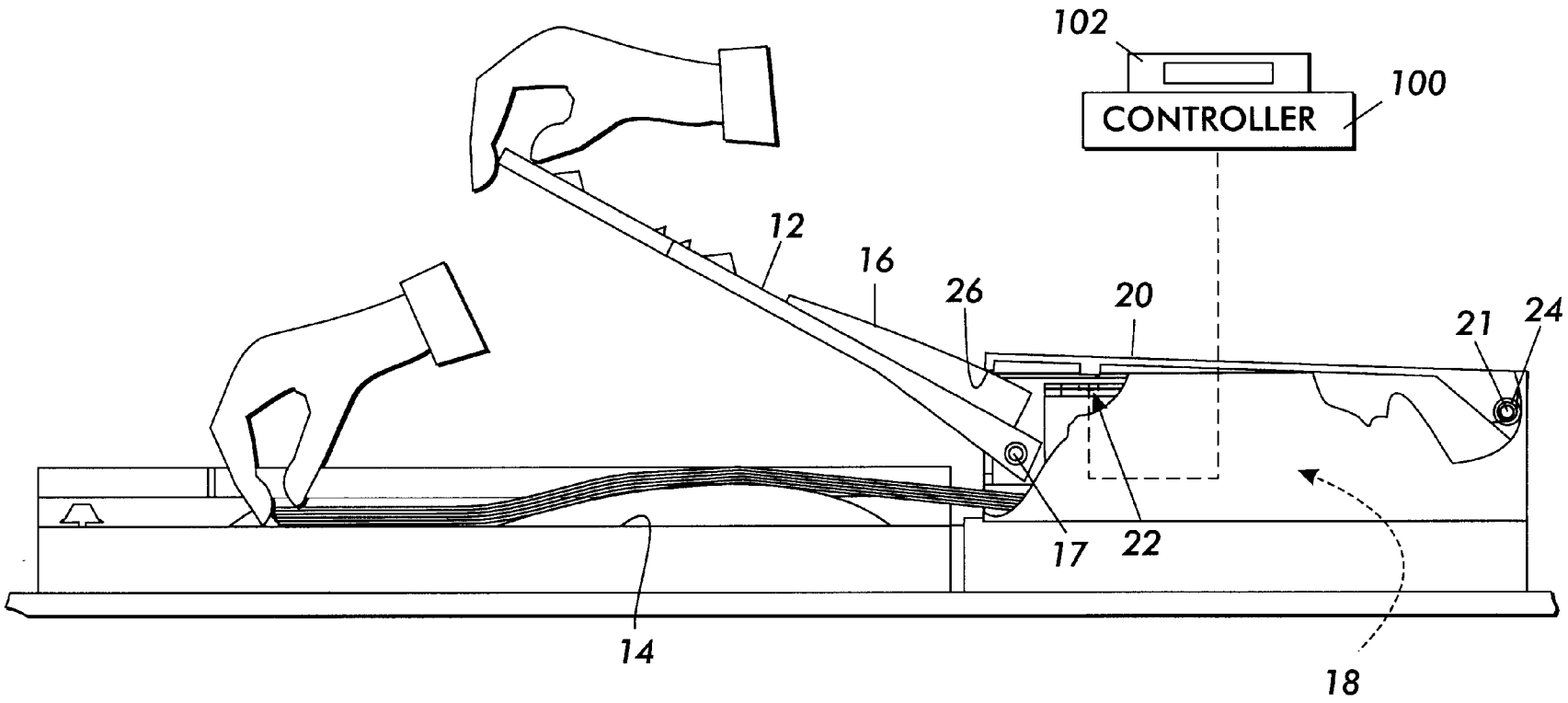
Figure 4:
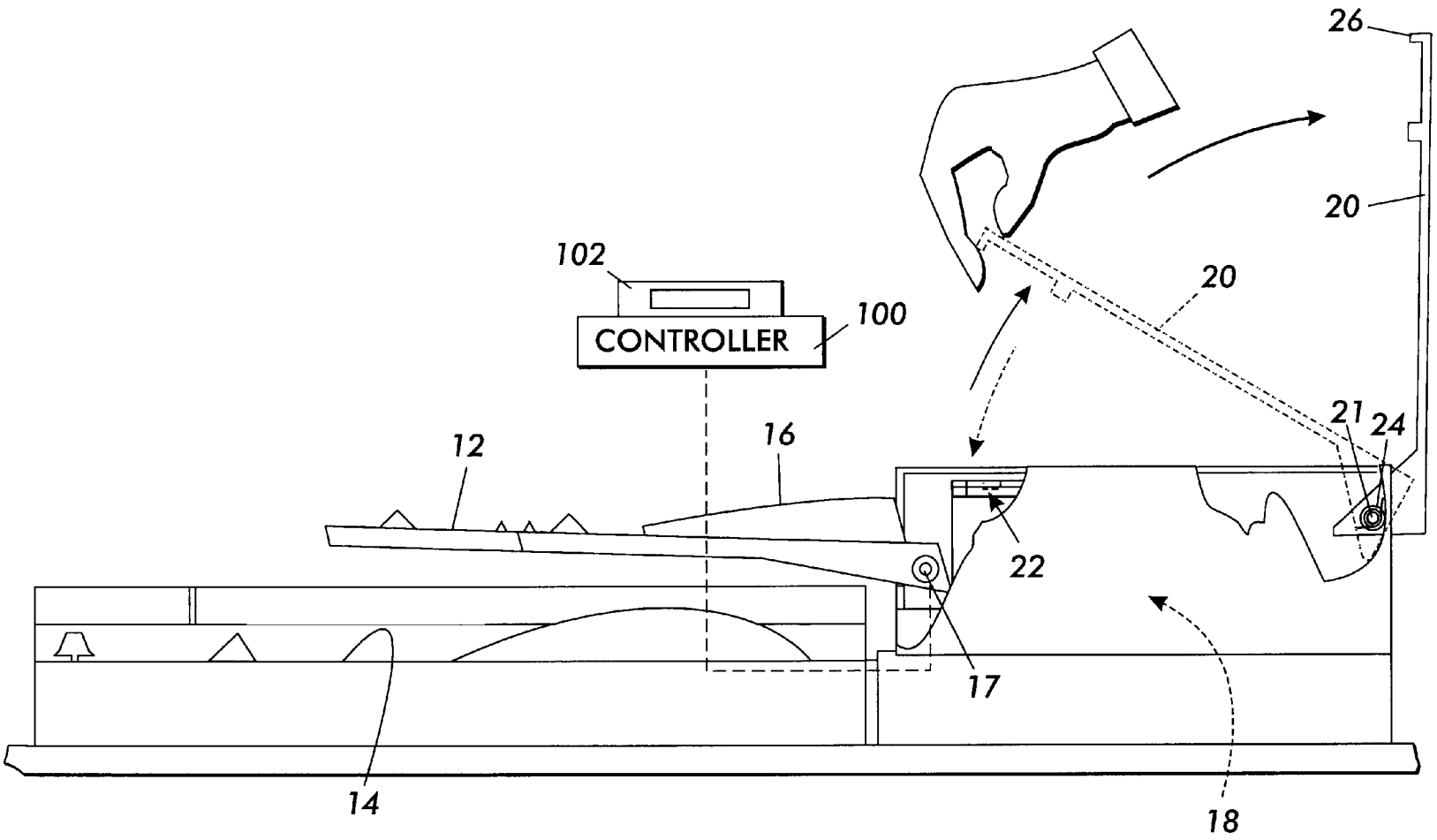

FIG. 3 shows the subsequent jam clearance step to that of FIG. 2, wherein sheets are being removed from under the now lifted out of the way upper tray; and FIG. 4 illustrates the automatically operator visually directed checking of the internal sheet path of the document handler by the automatic unlatching and partial lifting of the access cover by the initial single operator step illustrated in FIG. 2.

In the exemplary document handler 10 of FIGS. 1–4 (further described in the above-cited U.S. Pat. No. 5,534,989), the job or set of document sheets to be imaged are stacked in the upper or input document tray 12. The tray 12 overlies, and thus largely obstructs the view of, and access to, the lower document tray 14, which is utilized for both document sheet output and duplex document inversion. The superposing or overlying of the two trays 12 and 14 in this manner, however, desirably provides for a more compact overall document handler 10.

It may also be seen that the upper document tray 12 has upstanding side guides 16, and is cantilever pivotally mounted about a pivot axis 17 adjacent its inside end. The side cover of the document handler 10 is partially broken away in FIG. 2–4 to better show this pivotal mounting 17 of the upper document tray 12.

Figure 1:
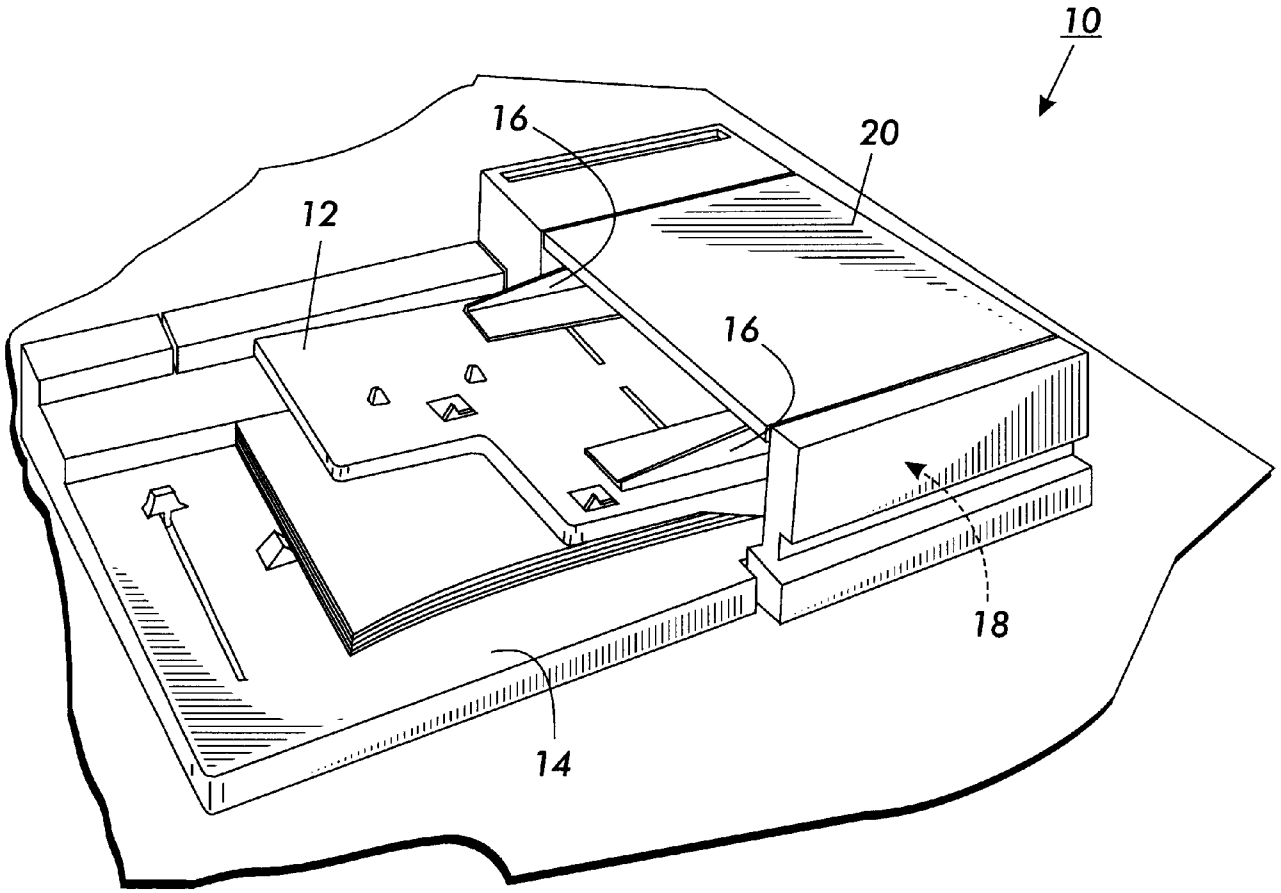
FIG. 1 is a perspective view of one example of an automatic document handler incorporating one example of the subject jam clearance system.

The internal paper feeding paths 18 of the document handler 10 are enclosed within an integral unit with an overlying top access cover 20, which, of course, must be closed for operation to prevent inadvertent operator access. FIG. 1 shows the document handler 10 in that normal operating state. The internal paper feeding paths 18 unit may be the same as that of the above-cited U.S. Pat. No. 5,534,989 or the like and thus need not be re-described here. That may conventionally be through machine controller 100, through the usual cover closure interlocks common to sheet feeding systems. Said '989 and other patents cited therein also show and describe sheet path sensors connecting to a controller which can provide a sheet jam signal generating system in the event of a sheet feeding jam.

The document handler top access cover 20 is pivotally mounted about a pivot axis 21 which is at the opposite side of the document handler 10 internal paper feeding path 18 from pivot axis 17. When the access cover 20 is pushed down, into its operating position, it is latched in position by a cover latch 22. Optional spring loading 24 may be provided to partially pop up and/or partially hold up the access cover 20 when this cover latch 22 is released. This cover latch 22 is preferably of the plastic detent or the like conventional type, i.e., a "pop open" with sufficient force type latch. It will be appreciated that the access cover 20 normally only needs to be lifted up in the event of the paper jam in the document handler 10 for checking the paper path 18 therein.

In the event of a paper jam, this condition will, of course, be displayed on a graphic user interface or GUI display 102 associated with the controller 100, or otherwise, on either the document handler 10 or an associated reproduction apparatus. The operator may be instructed to remove any jammed or partially job completed sheets in the lower document tray 14 by lifting the upper tray 12. As shown in FIG. 2 this is greatly facilitated and assisted in an intuitive manner by simply allowing the operator to lift the upper document tray 12 pivotally about its pivot access 17. This provides free and unobstructed access to remove those sheets in the lower tray 14 area, as clearly shown in FIG. 3. The tray 12 may be grasped and lifted anywhere, without requiring any unlatching first.

As also shown in FIG. 3, this same operator movement in lifting the upper document tray 12 for access to any underlying document sheets also, automatically, without any operator intervention or instruction, pops open the document handler's top access cover 20 by unlatching the cover latch 22 automatically by an engagement at 26. This is provided here with very low operator force because of the long lever arm provided by the cantilevered extending length of the upper document tray 12 as compared to the short engagement point 26 distance from the pivot axis 17. It may be seen that the upper surface of the side guides 16 engages and freely slides on this engagement point 26, which is at the outer end of the access cover 20, i.e., opposite from the pivot axis 21 of the access cover 20. Thus, a very large leverage advantage is provided for unlatching the access cover 20 latch 22 by the lifting of tray 12.

Thus, it may be seen that the simple operator lifting of the upper document tray 12, automatically, with low force, pops open the latch 22 to lift up the access cover 20. Since the access cover 20 is on top of the document handler 10 and readily visible, this automatically provides a visual indication to the operator that the cover 20 is lifted and that the now exposed internal paper feeding path 18 should also be checked for jammed sheets.

If the spring loading 24 does not totally open the access cover 20, the operator can simply lift that access cover 20 further open, as shown in FIG. 4. Furthermore, the upper tray 12 can meanwhile be let down into its normal operating position, as also shown in FIG. 4, freeing the operator's hands, yet the access cover 20 will stay open for jam clearance, until reclosed by the operator.

To redescribe the above in different words, a simple pivoting of the input tray up away from the output tray automatically opens the document handler access cover for access to the internal sheet feeding path therein for jam clearance, in a single motion, with low force. The access cover 20 is popped open even if latched by the tray pivot end pushing up against the underside of the access cover lid in a highly leveraged manner. This causes the operator to notice, and then, if necessary, further open this access cover or lid 20 to inspect for jams that may need to be cleared therein. With this system, in the event of a jam signal, it is both easy and intuitive to check for clearing the entire paper path, both underlying the input tray and also in the adjacent document feeding unit, which is normally not exposed. The operator simply lifts up anywhere on the cantilevered extending upper tray, which is pivotally mounted by its inside end inside the document feeding unit. This lifting of the tray not only exposes the area under the tray, it also automatically causes the appropriately designed and positioned smoothly curved upper surfaces of the sheet set side guides on this upper tray to automatically engage, pop open the latch, and lift up, the cover of the associated document feeding unit to automatically expose its paper path for jam clearance, with no additional required operator action, easily lifting both in one movement.

While the embodiment disclosed herein is preferred, it will be appreciated from this teaching that various alternatives, modifications, variations or improvements therein may be made by those skilled in the art, which are intended to be encompassed by the following claims.

What is claimed is:

1. In a sheet feeding system with an enclosed internal sheet feeding path unit and at least two connecting first and second sheet stacking trays, wherein said first sheet stacking tray is overlying said second sheet stacking tray, and wherein sheets are sequentially fed from at least one of said first or second superposed sheet stacking trays into said enclosed internal sheet feeding path unit; and wherein a sheet jam signal generating system is provided in the event of a sheet feeding jam; the improvement wherein:

said first sheet stacking tray is pivotally cantilever mounted adjacent one end thereof to said enclosed internal sheet feeding path unit at a first pivot axis and extends cantilevered from said enclosed internal sheet feeding path unit, said first sheet stacking tray being readily manually pivotal upwardly about said first pivot axis to expose said second sheet stacking tray in the event of said sheet feeding jam signal, said first sheet stacking tray having a camming surface adjacent to said first pivot axis and at least partially inside of said enclosed internal sheet feeding path unit;

said enclosed internal sheet feeding path unit having a top cover pivotally mounted to said enclosed internal sheet feeding path unit about a second pivot axis substantially spaced from said first pivot axis of said first sheet stacking tray, a releasable latching system latching said top cover down over said enclosed internal sheet feeding path unit, and said top cover having a latch releasing engagement surface positioned to be engaged by said camming surface of said first sheet stacking tray to automatically release said releasable latching system and at least partially open said top cover when said first sheet stacking tray is manually pivoted upwardly about said first pivot axis to expose said second sheet stacking tray.

2. The sheet feeding system of claim 1, wherein said first and second sheet stacking trays are respectively document input and document output trays, and wherein said enclosed internal sheet feeding path unit comprises a document imaging system.

3. The sheet feeding system of claim 1, wherein:

said enclosed internal sheet feeding path unit has first and second opposite sides, said first and second sheet stacking trays are mounted to said first side of said enclosed internal sheet feeding path unit, said first pivot axis is adjacent to said first side of said enclosed internal sheet feeding path unit, and said second pivot axis is adjacent to said second side of said enclosed internal sheet feeding path unit.

4. The sheet feeding system of claim 1, wherein said top cover is spring loaded to pop open and expose said enclosed internal sheet feeding path when said camming surface of said manually pivoted first sheet stacking tray engages said latch releasing engagement surface of said top cover and releases said releasable latching system.

5. The sheet feeding system of claim 4, wherein said camming surface of said first sheet stacking tray is an arcuate top surface of a sheet side guide on said tray, which sheet side guide is upstanding from said tray and extends into said enclosed internal sheet feeding path unit to engage said top cover when said tray is manually pivoted upwardly.

* * * * *